US007465070B2

(12) United States Patent
Engel

(10) Patent No.: US 7,465,070 B2
(45) Date of Patent: Dec. 16, 2008

(54) ILLUMINATION DEVICE

(76) Inventor: Hartmut S. Engel, Monrepos Strasse 7, 71634 Ludwigsburg (DE)

( * ) Notice: Subject to any disclaimer, the term of this patent is extended or adjusted under 35 U.S.C. 154(b) by 0 days.

(21) Appl. No.: 10/584,706

(22) PCT Filed: Nov. 26, 2004

(86) PCT No.: PCT/EP2004/013463

§ 371 (c)(1),
(2), (4) Date: May 10, 2007

(87) PCT Pub. No.: WO2005/066540

PCT Pub. Date: Jul. 21, 2005

(65) Prior Publication Data

US 2008/0025021 A1 Jan. 31, 2008

(30) Foreign Application Priority Data

Dec. 23, 2003 (DE) ..... 103 60 943

(51) Int. Cl.
*F21V 7/00* (2006.01)

(52) U.S. Cl. ..... 362/297; 362/298; 362/147

(58) Field of Classification Search ..... 362/217, 362/223, 225, 235, 285, 287, 297, 346, 147, 362/404, 427, 364, 365, 368
See application file for complete search history.

(56) References Cited

U.S. PATENT DOCUMENTS

| | | | | |
|---|---|---|---|---|
| 4,194,234 | A * | 3/1980 | Geissler | 362/17 |
| 4,967,324 | A * | 10/1990 | Barclay | 362/147 |
| 5,564,815 | A * | 10/1996 | Littman et al. | 362/147 |
| 5,944,411 | A * | 8/1999 | Holten et al. | 362/342 |
| 6,467,934 | B1 * | 10/2002 | Holten et al. | 362/298 |
| 6,517,216 | B1 * | 2/2003 | Cercone et al. | 362/220 |
| 6,582,099 | B2 * | 6/2003 | Bartenbach | 362/291 |
| 6,641,282 | B2 * | 11/2003 | Perlo et al. | 362/217 |
| 6,793,368 | B2 * | 9/2004 | Ladstatter | 362/217 |
| 2002/0024815 | A1 | 2/2002 | Haenen et al. | |
| 2002/0064047 | A1 | 5/2002 | Stauner et al. | |

FOREIGN PATENT DOCUMENTS

| | | | |
|---|---|---|---|
| DE | 10151958 | A1 | 4/2003 |
| EP | 0359069 | A2 | 3/1990 |

* cited by examiner

*Primary Examiner*—Thomas M Sember
(74) *Attorney, Agent, or Firm*—Gifford, Krass, Sprinkle, Anderson & Citkowski, P.C.

(57) ABSTRACT

The invention relates to an illumination device which comprises a plurality of downlight reflectors (1) that are impinged upon by illumination means and that have respective front reflector openings (2) pointing in the direction of illumination. The invention is characterized in that at least two downlight reflectors can be impinged upon by a common illumination means (5) via respective rear reflector openings.

20 Claims, 10 Drawing Sheets

ILLUMINATION DEVICE

CROSS-REFERENCE TO RELATED APPLICATIONS

This application is a National Stage of International Application No. PCT/EP2004/013463, filed Nov. 26, 2004, and which claims the benefit of DE 103 60 943.1, filed Dec. 23, 2003. The disclosures of the above applications are incorporated herein by reference.

FIELD

This invention relates to a lighting device comprising a plurality of downlight reflectors illuminated by an illuminant which each have a front reflector opening disposed in the direction of illumination.

BACKGROUND

The statements in this section merely provide background information related to the present disclosure and may not constitute prior art.

Lighting devices of the named kind as a rule consist of a plurality of individual downlights which each have their own housing and which are each arranged at different positions in dependence on the technical lighting demands prevailing on site in the ceiling region of a room. Such downlights are frequently also arranged directly adjacent to one another or used in combination with strip lamps and/or louver lamps whose size e.g. coincides with the size of ceiling elements of suspended grid ceilings.

The fact is disadvantageous in lighting devices of the said type that downlights and strip lamps or louver lamps have different designs and thus do not present a uniform appearance. Furthermore, servicing, in particular the cleaning and replacing of illuminants, is associated with a comparatively high effort when individual downlights are used.

SUMMARY

An object of the invention consists of further developing a lighting device of the initially named kind such that a uniform design can even be achieved with the combined use of individual downlights and strip lamps or louver lamps, with the effort for the servicing of the lighting device in particular being reduced.

This object is satisfied in accordance with the invention in that at least two downlight reflectors can be illuminated by a common illuminant via a respective rear reflector opening.

In contrast to the lighting devices known from the prior art, in which a separate illuminant and, as a rule, also a separate housing are provided for each downlight reflector, two or more downlight reflectors are now illuminated by a common illuminant in accordance with the invention, which advantageously has the result that only one single illuminant has to be serviced or replaced as required in connection with the said two or more downlight reflectors. The servicing effort is thereby substantially reduced by the use of a lighting device in accordance with the invention.

Furthermore, in accordance with the invention, a plurality of downlight reflectors illuminated by a common illuminant can be arranged next to one another, in particular along a straight line or along a plurality of lines extending in parallel so that these downlight reflectors ultimately have a lighting characteristic similar to a strip lamp or a louver lamp as a group. The use of such a group acting as a strip lamp or louver lamp together with individual downlights thus permits a uniform and matched design of a lighting system consisting of the named components.

It is preferred for the downlight reflectors illuminated by the common illuminant in each case to represent separate units not directly connected to one another. These downlight reflectors can then also be used for individual downlights in practically unchanged form, which has a favorable effect on the manufacturing effort of lighting systems consisting of lighting devices in accordance with the invention and individual downlights.

The openings of the front downlight reflectors disposed in the direction of illumination can have a shape at least substantially point-symmetrical, in particular circular, toward the center of the opening. However, any other opening shapes are also equally possible.

The downlight reflectors advantageously each have a dome or cupola shape open at both sides, with the larger opening forming the front reflector opening in accordance with the invention and the smaller opening forming the rear reflector opening in accordance with the invention.

It is sensible for a uniform handling of the lighting device in accordance with the invention in its assembly and disassembly for the downlight reflectors illuminated by the common illuminant to be arranged, including the illuminant, in a common housing.

In specific applications, it is advantageous for at least two downlight reflectors to be illuminated by a plurality of common illuminants. This is, for example, sensible when a relatively high intensity of illumination is necessary which can be effected, for example, by the use of two or three fluorescent tubes extending parallel to one another, of which each single one illuminates the at least two downlight reflectors. The use of a plurality of common illuminants is in particular sensible when this plurality of illuminants have different color shades from one another. For example, three white shades differing from one another can be used whose respective illumination intensity can be controlled. The respectively desired light mix can then be set by a corresponding control of the individual illuminants.

It is particularly preferred for two or more downlight reflectors to be illuminated by three common illuminants which have the color shades red, green and blue, with the illumination intensity of the individual illuminants in turn being able to be set directly independently of one another. Any desired color shade and thus any desired color light atmosphere or also white light can be set by means of such an "RGB" illumination by a direct control of the three illuminants.

A particular advantage of the invention lies in the fact that the three named lamps can be arranged in accordance with the invention very closely to one another in the region of the rear reflector openings so that a very good mix of the individual color shapes already results within every single downlight reflector.

The illuminants are preferably made as fluorescent lamps or compact fluorescent lamps in accordance with the invention since their elongated shape is particularly well suited to illuminate a plurality of downlight reflectors arranged in a row.

The downlight reflectors can be held pivotally in a housing in a possible embodiment. The direction of illumination can be set in a respectively desired manner by this pivoting capability. The different downlight reflectors illuminated by a common illuminant can be pivoted either independently of one another or, via a suitable mechanical coupling, together with one another.

In particular when the downlight reflectors can be pivoted independently of one another, it is sensible for the illuminant illuminating the downlight reflectors to be arranged statically in the housing so that it is not taken along in the said pivot movements. If, however, the downlight reflectors, can be pivoted together with one another, the illuminant illuminating them can again either be arranged statically in the housing or can be mechanically coupled to the downlight reflectors such that the illuminant is carried along in the pivot movement of the downlight reflectors. In the latter case, an optimum relative position can be ensured in every pivot angle position between the illuminant and the downlight reflectors and thus an optimum illumination of the downlight reflectors via the illuminant.

In a particularly preferred embodiment of the invention, the front reflector openings of the downlight reflectors can define direct light discharge regions which are surrounded at least regionally by at least one diffuse light discharge region. In this case, it is possible to work according to the dark-light principle in the direct light discharge region, according to which principle the illuminant and the reflector are arranged with respect to one another such that the illuminant can no longer be seen from a specific angle of observation and thus cannot develop any glare effect. At the same time, however, scattered light exits the diffuse light discharge region in accordance with the invention around the said direct light discharge region, said scattered light being visible as non-glaring ambient light so that it is always ensured that the observer can perceive where the respective light source is located. This results in a room mood with a good light atmosphere perceived as pleasant despite the use of the dark light principle. In addition, a generation of softer shadows and an advantageous wall brightening is achieved by the scattered light being discharged through the diffuse light discharge region.

In addition to these advantages, interesting design possibilities result from the diffuse light discharge region, for example by an individual choice of the shape of the diffuse light discharge region or of the color of the discharged scattered light.

In particular with the use of a plurality of illuminants of different color shades which jointly illuminate both the direct light discharge region and on the diffuse light discharge region, it is of advantage that a particularly good mixing of the different color shades results in the region of the diffuse light discharge region.

As already mentioned above, the direct light discharge regions and the diffuse light discharge regions can be illuminated by a common illuminant so that ultimately any existing illuminant illuminates all direct light discharge regions of the different downlight reflectors and simultaneously on all diffuse light discharge regions. In this manner, it is not necessary to provide separate illuminants for the diffuse light discharge regions, which is advantageous with respect to the illuminant costs and the effort to be carried out on a changing of the illuminants.

The front reflector openings defining the direct light discharge regions can be associated with a respective direct light reflector made as a downlight reflector in accordance with a preferred embodiment on whose side remote from the direct light discharge region an additional reflector or background reflector is provided which illuminates both the direct light discharge regions and the diffuse light discharge regions. With an arrangement of this kind, the illuminant radiates direct light into the actual direction of illumination directly or via the direct light reflector, on the one hand, and in a direction opposite to the direction of illumination toward the additional reflector, on the other hand, which deflects some of the light incident on it in the direction of the diffuse light discharge region and some of the light to the direct light discharge direction in dependence on its design such that this additional reflector also contributes to the increase in efficiency in the generation of direct light. This additional reflector can reflect either in a specularly reflecting manner or in a diffuse manner, with a conversion from directly reflected light into scattered light being able to take place in the region of the diffuse light discharge region in the first-named case.

It is preferred for a light passage region to be formed between the additional reflector and the direct light reflector such that the additional reflector can deflect that portion of the light which should correspond to the diffuse light portion past the outer side of the direct light reflector to the diffuse light discharge region.

The additional reflector can be made at least in part by at least one planar or presetably curved or kinked reflector surface. As already mentioned, the ratio of the light portions which are deflected to the direct light discharge region and to the diffuse light discharge region can be directly adjusted by a suitable curvature or kinking of the additional reflector. To achieve a high efficiency of the lighting device in accordance with the invention, the additional reflector is shaped such that a high light portion passes to the direct light discharge regions and only a small light portion to the diffuse light discharge regions.

The illuminant, direct light reflectors and additional reflectors can be arranged in a common housing whose inner surface is made at least regionally as an additional reflector. It is thereby achieved in an advantageous manner that no additional components are required for the additional reflector.

The direct light reflectors can be made as specularly reflecting or diffusely reflecting on their outer sides so that the light illuminating the diffuse light discharge regions can also be guided via the outer sides of the direct light reflectors. The outer sides of the direct light reflectors in this case form regions of the additional reflector or background reflector.

The housing containing the lighting device in accordance with the invention is advantageously made lightproof since in this case, for example with suspended ceilings, irregularities in the finishing are not unintentionally illuminated from behind. The housing can furthermore be made dustproof in order thus to counter contamination of the illuminant and reflectors caused, for example, by air-conditioning systems.

It is particularly advantageous for the housing to be terminated in at least a largely dustproof manner by a scattering plate in the region of the diffuse light discharge regions and by an in particular transparent plate in the region of the direct light discharge regions. In this manner, a frequent cleaning of the reflectors and of the illuminant can be avoided since the named plates form reliable protection against dust.

Alternatively, however, it is also possible with a more cost-favorable version to cover the housing in the region of the diffuse light discharge region by a scattering plate or by an element having apertures, in particular a perforated plate, and to make it open in the region of the direct light discharge regions.

Further preferred embodiments of the invention are set forth in the dependent claims.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
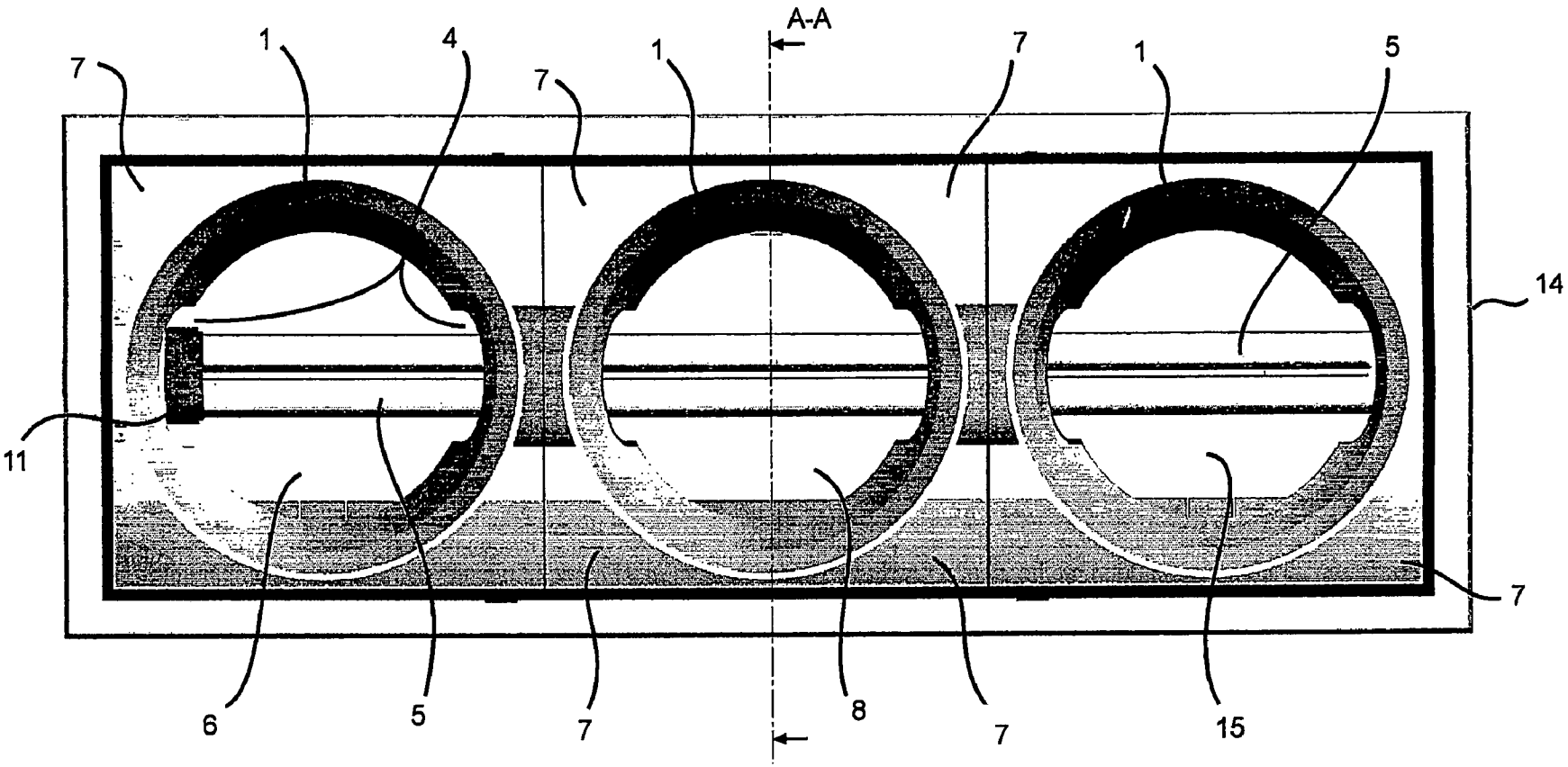
FIG. 1 is a plan view of a lighting device in accordance with the invention.

The following description is merely exemplary in nature and is not intended to limit the present disclosure, application, or uses. It should be understood that throughout the drawings, corresponding reference numerals indicate like or corresponding parts and features.

Figure 2:
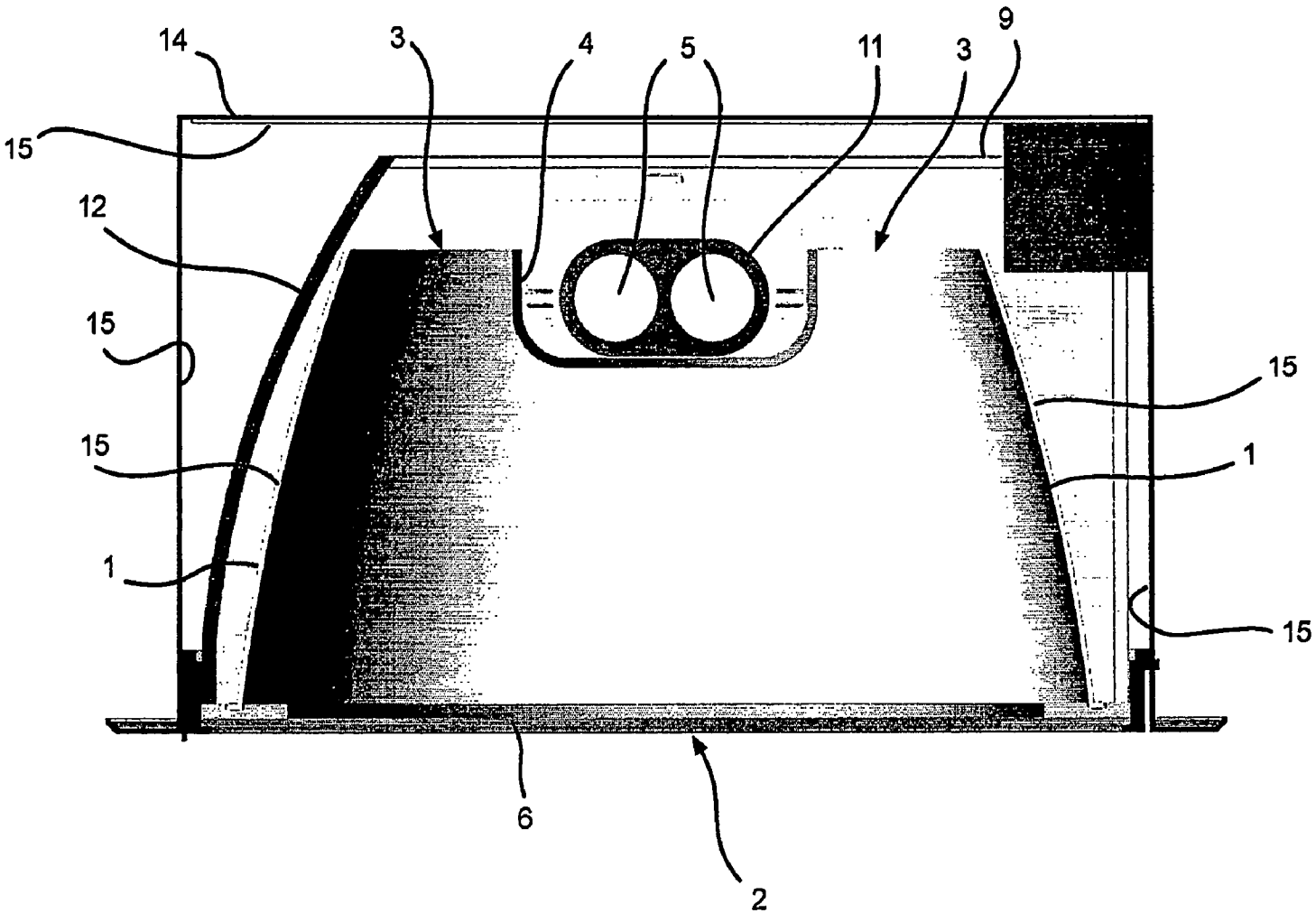
FIG. 2 is a section through a lighting device of FIG. 1 along the section line A-A.
Figure 3:
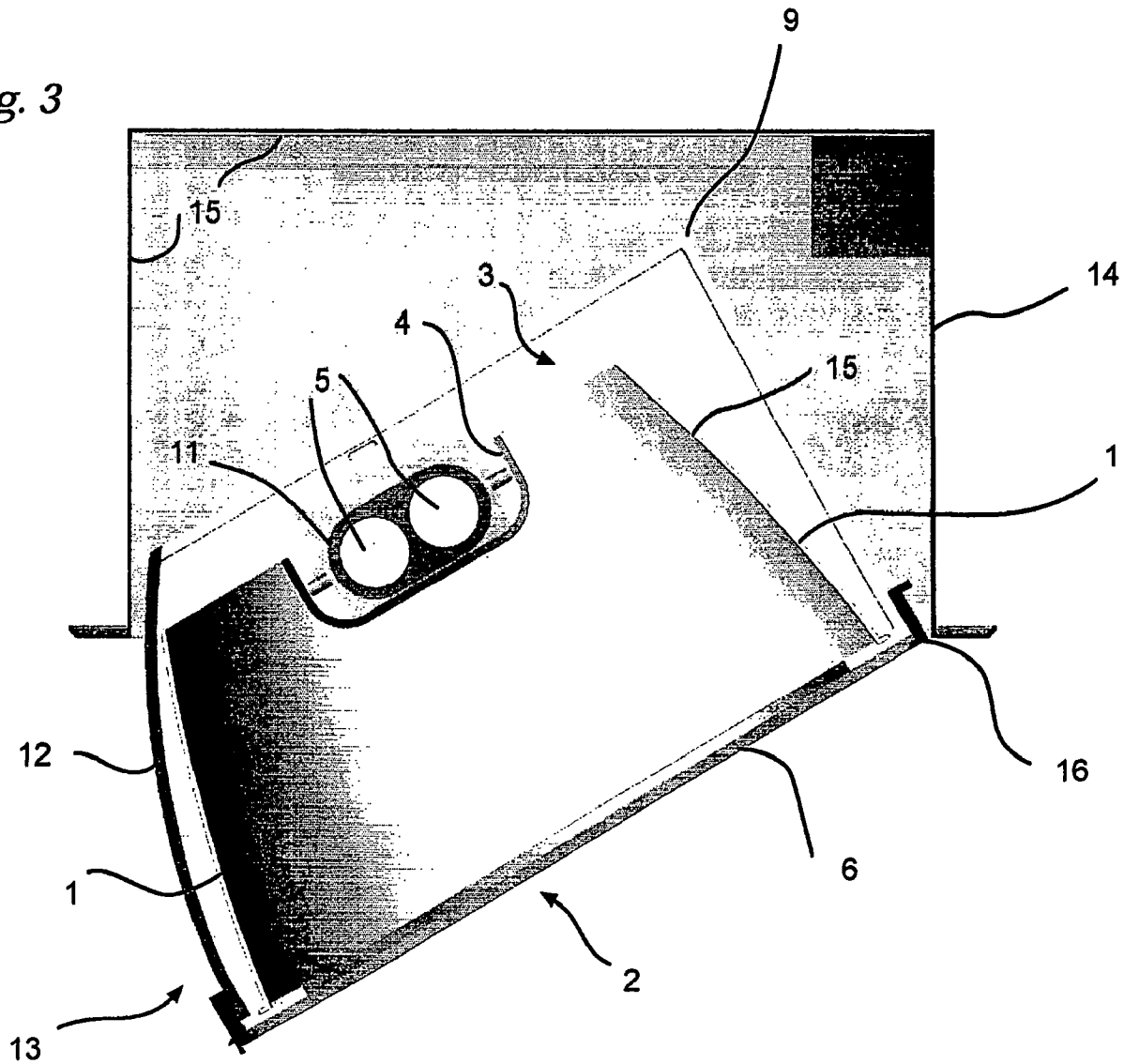
FIG. 3 is a view corresponding to FIG. 2 with a pivoted downlight reflector.
Figure 4:
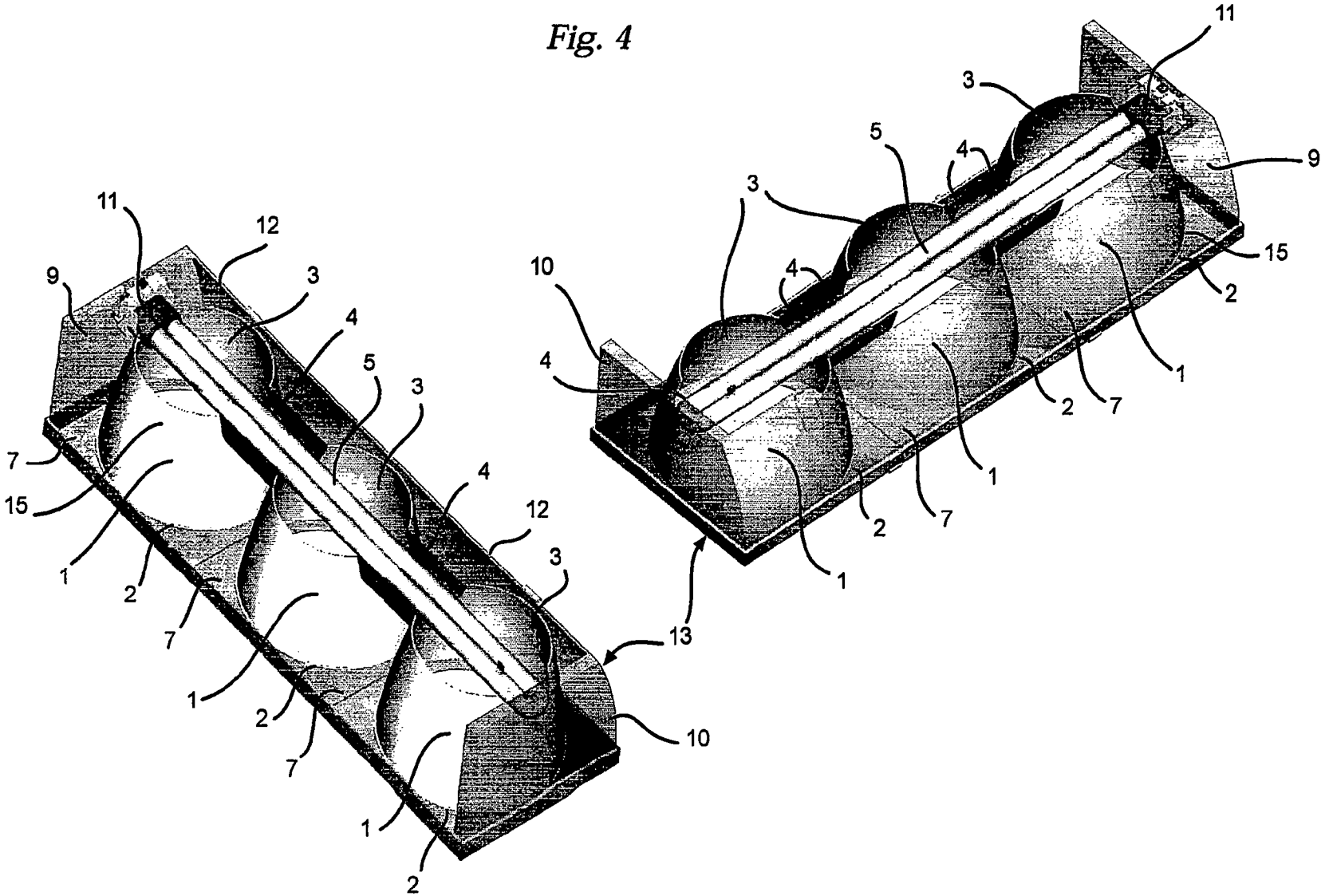
FIG. 4 is two different perspective views of the region of the lighting device in accordance with the invention pivotal in accordance with FIG. 3.

FIGS. 1 to 3 show the aforesaid views of a possible embodiment of a lighting device in accordance with the invention. FIG. 4 shows, in two perspective views, that part of the said lighting device which is pivotal in accordance with FIG. 3. The following explanations relate to FIGS. 1 to 4.

The lighting device comprises a total of three downlight reflectors 1, with each of these downlight reflectors 1 having a dome or cupola shape open at both sides. The downlight reflectors 1 each have a front reflector opening 2 disposed in the direction of illumination and a rear reflector opening 3 disposed opposite to the direction of illumination. The downlight reflectors 1 each have two mutually disposed cut-outs 4 in the region of the rear reflector openings 3. Due to the cut-outs 4, an illuminant 5 made as an elongate fluorescent lamp can be positioned such that it extends from the rear reflector opening 3 into the downlight reflectors 1. Alternatively, the cut-outs 4 can also be omitted. In this case, the illuminants are then positioned behind or above the rear reflector openings 3 so that they do not extend into the reflectors 1.

While the rear reflector openings 3 are open, the front reflector openings 2 of all three downlight reflectors 1 are closed in a dustproof manner by a respective circular transparent plate 6.

The rim of the front reflector openings 2 of each downlight reflector 1 is adjacent in each case to a diffuse light discharge region 7 which surrounds the direct light discharge region 8 bounded by the front reflector opening 2. The direct light discharge region 8 and the diffuse light discharge region 7 extend in a common plane perpendicular to the direction of illumination. The diffuse light discharge region 7 of each downlight reflector 1 is bounded at the inside by the circular front reflector opening 2. At the outside, the diffuse light discharge regions 7 are each bounded by a square line, with the points of intersection of the diagonals of the corresponding square coinciding with the center of the circular front reflector opening 2. The direct light discharge regions 8 are thus each arranged centered in the associated diffuse light discharge regions 7.

The diffuse light discharge regions 7 each consist of a square scattering plate or of a common rectangular scattering plate which is suitable to convert direct light into diffuse light. This scattering plate can be made integrally with the transparent plate or plates 6 which terminate the front reflector openings 2 in a dustproof manner. Furthermore, the diffuse light discharge regions 7 can in particular be made integrally with the downlight reflectors 1 associated with them in each case, in particular in the course of an injection molding process.

The diffuse light discharge regions 7 of adjacent downlight reflectors 1 are adjacent to one another directly at the sides facing one another so that the three diffuse light discharge regions 7 together form a rectangle in accordance with FIG. 1 whose longitudinal sides are three times as long as its narrow sides.

The two mutually remote outer sides of the outer diffuse light discharge regions 7 are connected to wall elements 9, 10 which extend perpendicular to the diffuse light discharge regions 7 in the same direction as the downlight reflectors 1. The wall element 9 is provided in its region remote from the diffuse light discharge region 7 with an illuminant fitting 11 into which the illuminant 5 is fitted. The length of the illuminant 5 is dimensioned such that it extends through all of the total six cut-outs 4 of the downlight reflectors 1 so that all three downlight reflectors 1 can be illuminated by light via the illuminant 5. If no cut-outs 4 are provided, the illuminant 5 extends over all downlight reflectors 1 behind or above their rear reflector openings 3.

The wall elements 10, 11 have a substantially rectangular shape, with a side of the wall elements 9, 10 adjacent to the diffuse light discharge regions 7, however, being arc-shaped. The two arcuate sides of the wall elements 9, 10 are connected to one another via an arched wall element 12 (see FIG. 4) which extends areally from the diffuse light discharge regions 7 up to and beyond the region of the rear reflector openings 3 (see FIG. 2).

Downlight reflectors 1, diffuse light discharge regions 7, wall elements 9, 10, 12, illuminant fitting 11 and illuminant 5 form a unit 13 which is rigid per se and mutually mechanically coupled and which is shown perspectively in FIG. 4.

The unit 13 is arranged in a lightproof and dustproof housing 14 which substantially has the shape of a parallelepiped and is dimensioned such that it can fully receive the unit 13. The inner sides of the housing 14 are made reflecting, as are the outer sides of the downlight reflectors 1, so that they can act as additional reflectors or background reflectors 15. The arched wall element 12 can be made either reflecting on its side facing the downlight reflectors 1 to thus likewise form a region of an additional reflector or background reflector 15 or it can be made as a scattering plate so that only a portion of the light incident onto the arched wall element 12 is reflected and the other portion passes through the arched wall element 12 as scattered light.

As can be seen from FIG. 3, the unit 13 can be pivoted relative to the housing 14 around an axis 16, which has the consequence that an inclination of the diffuse light discharge regions 17 is adopted together with the direct light discharge regions 8. The direction of illumination can thereby be changed in the respectively desired manner. In the outwardly pivoted position of the unit 13, the outer side of the arched wall element 12 becomes visible, which ultimately provides an appealing appearance of the total lighting device, since the arched wall element 12 covers the interior workings of the lighting device in a visually appealing manner in the outwardly pivoted state. The arched wall element and also the outwardly pivoted wall elements 9, 10 can be made as scattering plates so that scattered light also passes through them, which brings about a visually appealing effect and additionally a brightening of the room ceiling.

It can be seen from FIGS. 1 to 4 that the sections of the illuminant 5 located inside the rear reflector openings 3 directly charge the respective interior space of the downlight reflectors 1 and the transparent plates 6 with light which ultimately exits the direct light discharge regions 8. Furthermore, the sections of the illuminant 5 disposed outside the rear reflector openings 3 illuminate the diffuse light discharge regions 7 directly, on the one hand, and indirectly, on the other hand, via the reflecting outer sides of the downlight reflectors and the reflecting inner sides 15 of the housing 14. This light portion then exits the diffuse light discharge regions 7 as scattered light.

Figure 5:
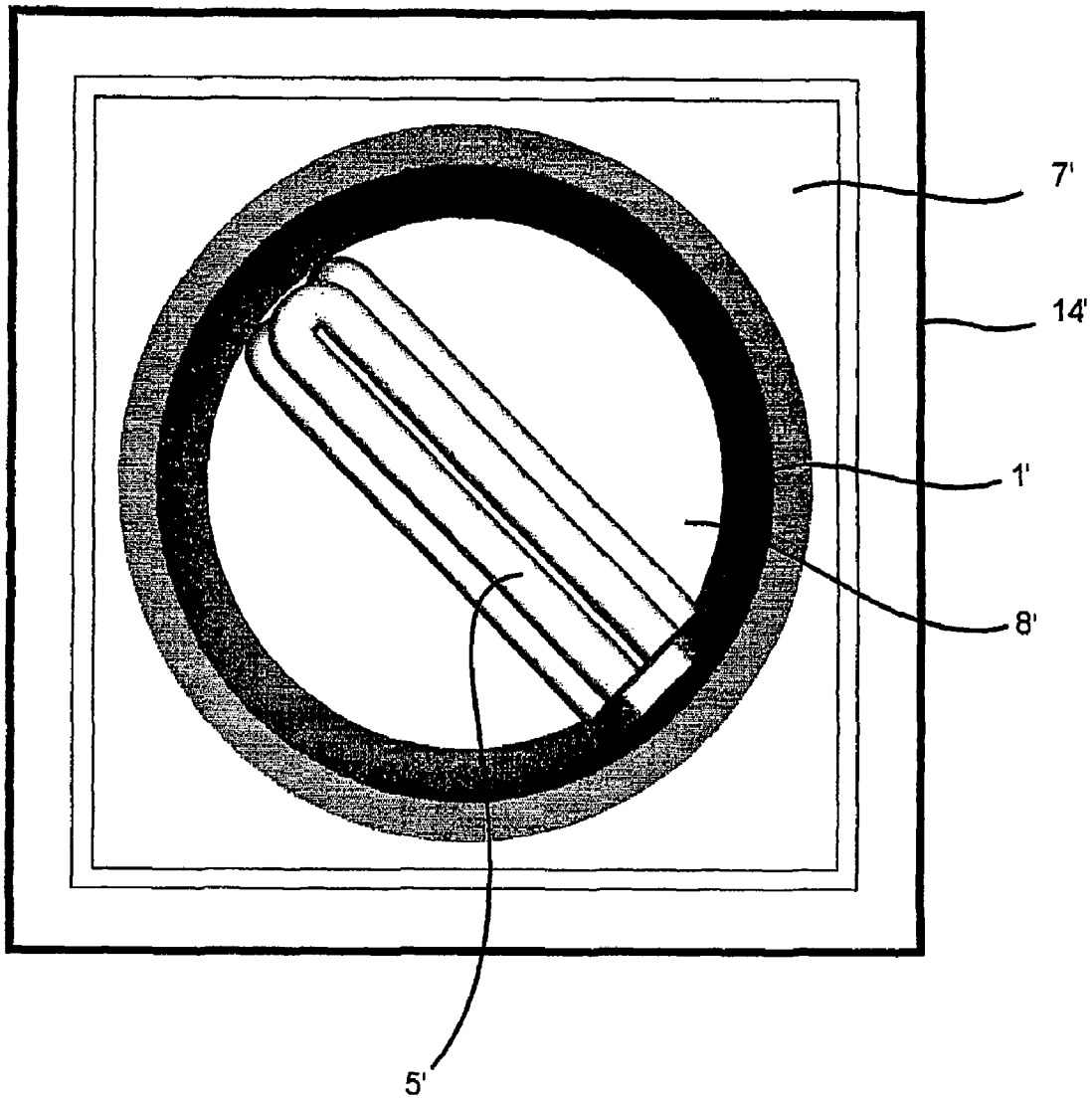
FIG. 5 is a plan view of a single downlight usable in conjunction with a lighting device in accordance with the invention.

FIG. 5 shows a plan view of an individual downlight which can be used in connection with a lighting device in accordance with the invention in accordance with FIGS. 1 to 4. To achieve a uniform design of the illumination device in accordance with the invention and of the individual downlight in accordance with FIG. 5 here, the individual downlight in accordance with FIG. 5 can be set up in accordance with the lighting device of FIGS. 1 to 4. The main difference to the lighting device in accordance with the invention of FIGS. 1 to 4 can accordingly be seen in that only one individual downlight reflector 1' is arranged in a housing 14' and is illuminated by an illuminant 5' whose length is dimensioned such that it finds room substantially in the interior space of the individual downlight reflector 1'.

The individual downlight in accordance with FIG. 5 also has a circular direct light discharge region 8' which is surrounded by a diffuse light discharge region 7' which is bounded at the outer side by a square line. Accordingly, the illuminant 5' is also suitable to illuminate both the direct light discharge region 8' and the diffuse light discharge region 7' directly or via background reflectors and additional reflectors.

A comparison of FIGS. 1 and 5 shows that the lighting devices shown in these two Figures have a uniform design line and can thus be used in combination with one another in a visually very advantageous manner.

FIGS. 6 to 9 show the views already named above of a further embodiment of a lighting device in accordance with the invention which has a total of nine downlight reflectors 1. The following description accordingly relates to FIGS. 6 to 9 together.

The lighting device shown specifically consists of three lighting devices in accordance with the invention which are arranged parallel to one another and which each comprise three downlight reflectors, with the three lighting devices being arranged adjacent to one another such that in total a square matrix arrangement of 3×3 downlight reflectors 1 results.

The two outer lighting devices each comprising three downlight reflectors 1 are thus made as already explained in connection with FIGS. 1 to 4. This means that these two lighting devices have pivotal units 13, with them being oriented with respect to one another in accordance with FIGS. 8 and 9 such that the units 13 can be pivoted to one another. Alternatively, an arrangement would also be feasible in which both units 13 can be pivoted in the same direction or away from one another.

The lighting device arranged between the two outer lighting devices and again comprising three downlight reflectors 1 differs from the outer lighting devices in that, instead of the pivotal unit 13, it has one unit attached rigidly in the housing and comprising three downlight reflectors and one elongate illuminant. Alternatively, however, the middle lighting device could also be formed pivotally.

Figure 6:
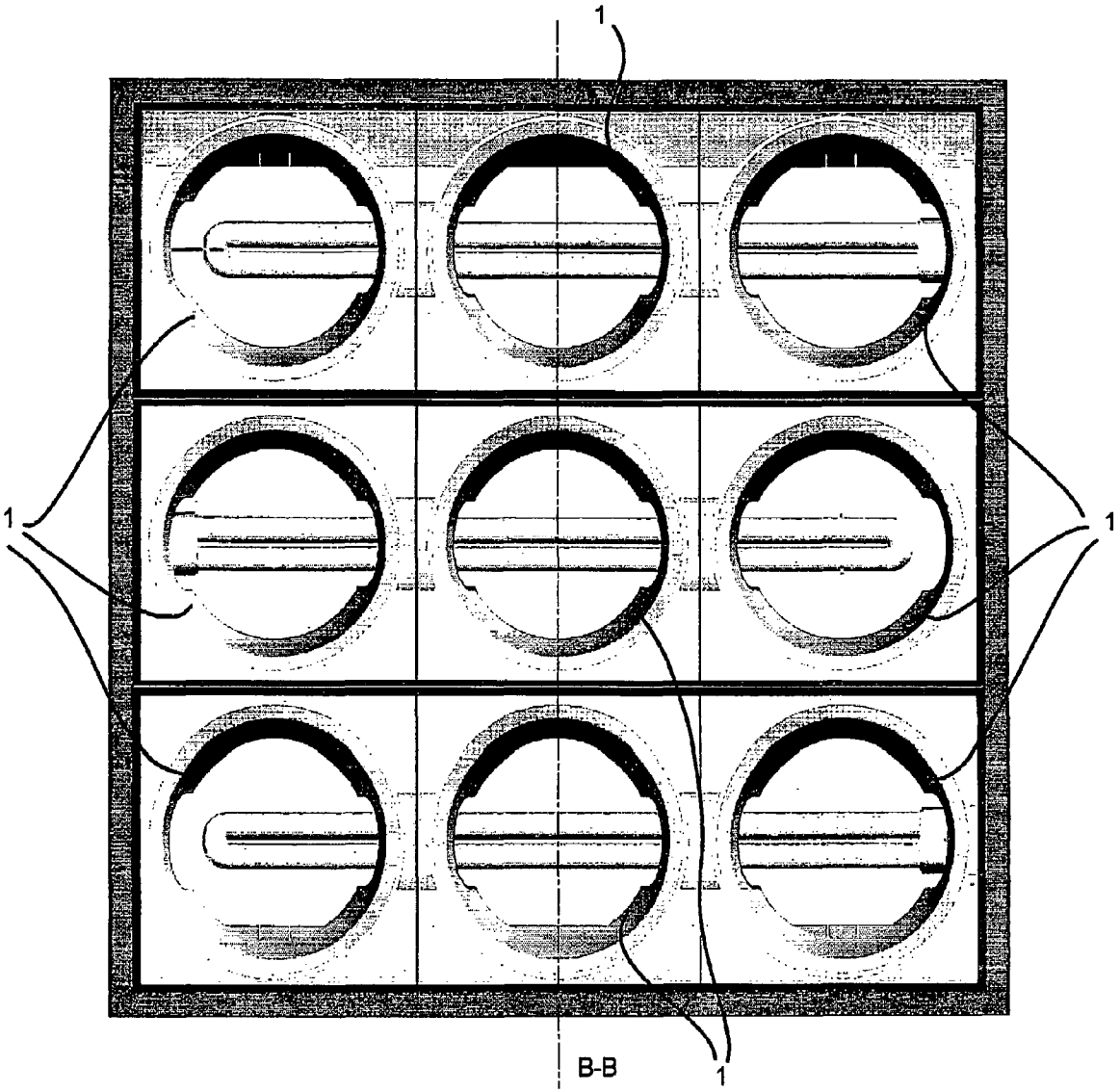
FIG. 6 is a plan view of a square lighting device which is composed of a total of three lighting devices in accordance with the invention.
Figure 7:
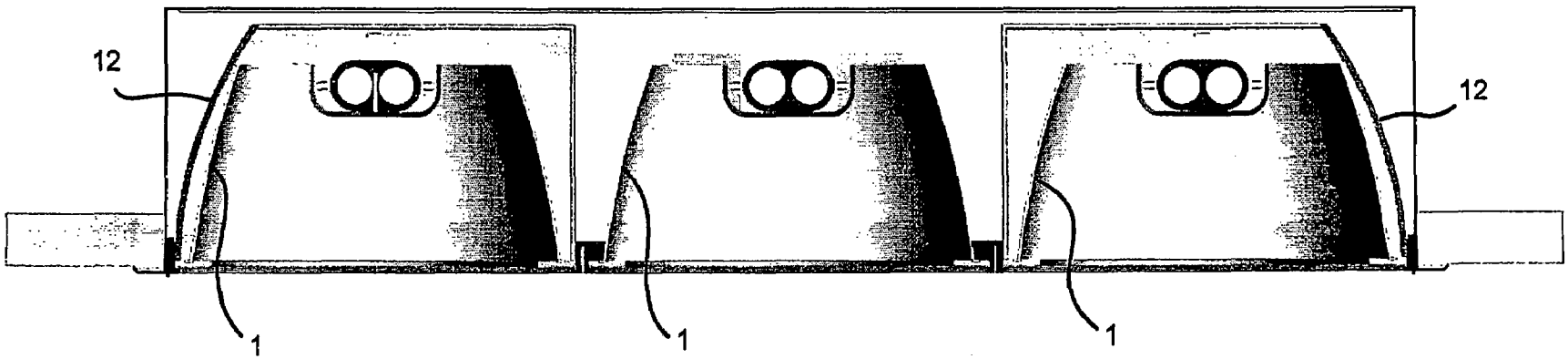
FIG. 7 is a section through a lighting device of FIG. 6 along the section line B-B.
Figure 8:
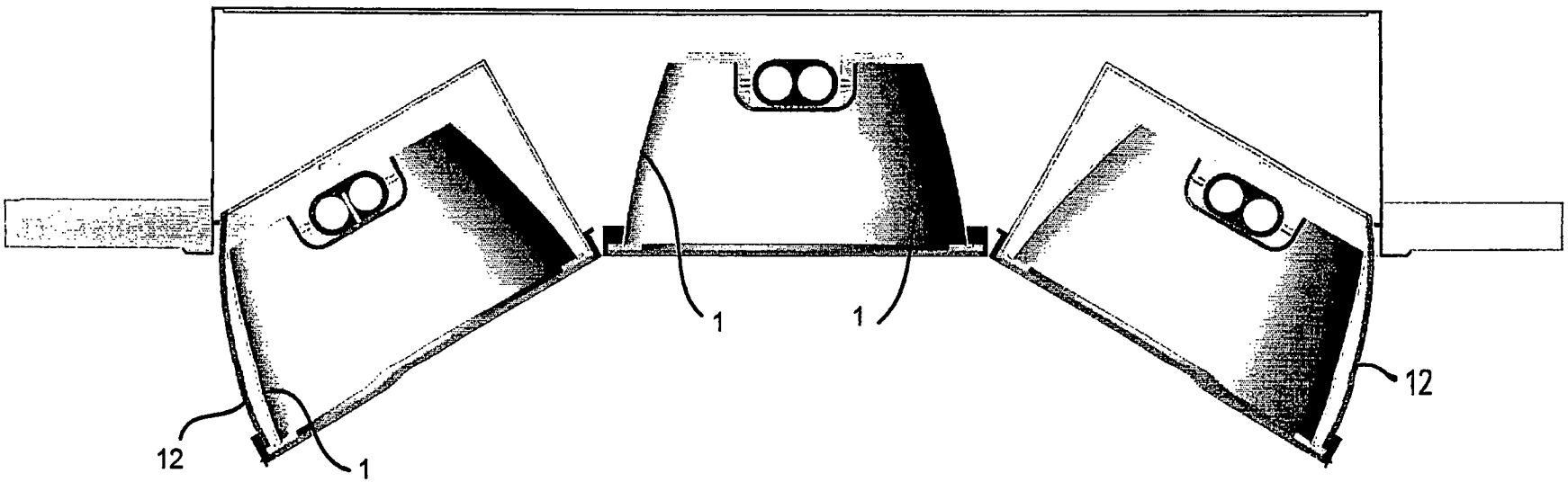
FIG. 8 is a view in accordance with FIG. 7 with two outwardly pivoted regions.
Figure 9:
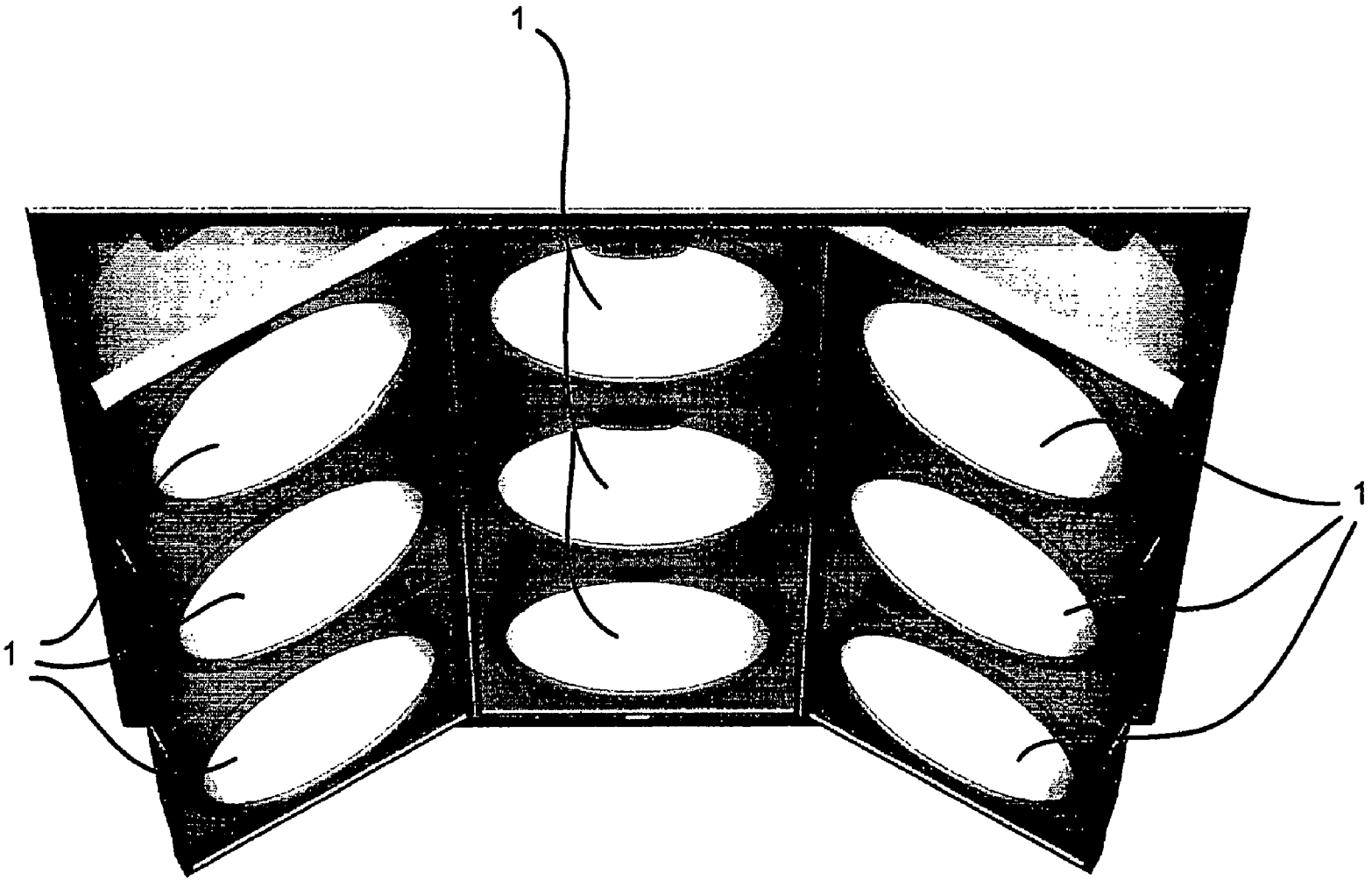
FIG. 9 is a perspective view of a lighting device corresponding to FIG. 8.

FIGS. 1 and 6 show that lighting devices in accordance with the invention can be used in any desired combinations. In this connection, every single lighting device can also have fewer or more than three downlight reflectors which are arranged in a row. Three lighting devices in accordance with FIG. 1 can naturally also be arranged, for example, adjacent to one another such that a total of nine downlight reflectors are located in a single row, whereby a strip lamp with a large longitudinal extent results.

Figure 10:
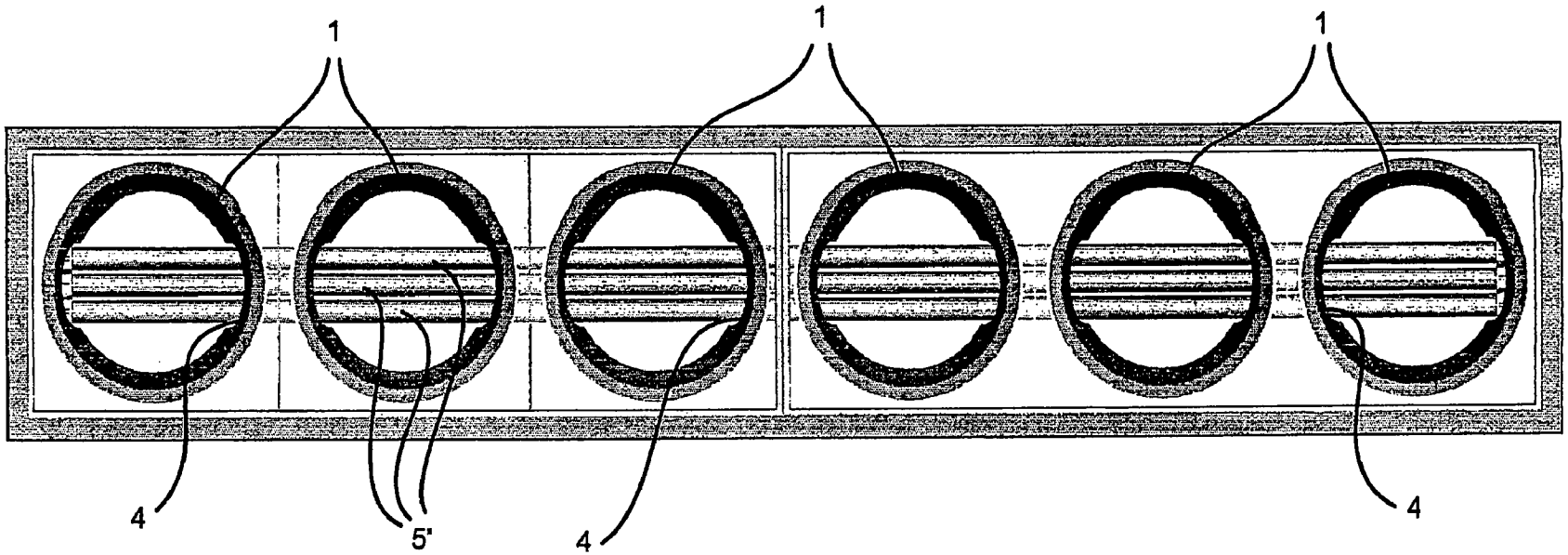
FIG. 10 is a further embodiment of a lighting device in accordance with the invention with a plurality of illuminants, which jointly illuminate a total of six downlight reflectors.

FIG. 10 shows a further embodiment of a lighting device in accordance with the invention in which a total of six downlight reflectors 1 come to lie next to one another in a row. All the downlight reflectors are each illuminated by a total of three illuminants 5" which have different color shades from one another and whose longitudinal extent is dimensioned such that all three illuminants 5" extend through the cut-outs 4 of all six downlight reflectors 1.

FIG. 10 illustrates that the different color shades of the three illuminants 5" can already mix in the interior space of the downlight reflectors 1, which is of advantage from a technical lighting aspect with respect to those apparatus in which the light sources having different shades are spaced relatively far apart from one another in space.

A good mix of the different color shades also results in the region of the diffuse light discharge regions 7 which are present in accordance with FIG. 10 analog to FIG. 1, said mix being in particular promoted in that a portion of the light illuminating the diffuse light discharge regions 7 is mixed particularly well by multiple reflection at the background reflectors or additional reflectors in accordance with FIG. 2.

If the three illuminants 5", which can, for example, have the color shades red, green and blue, can optionally be controlled with different energy, visible light can be generated in any desired frequency for the respective light atmosphere just desired using a lighting arrangement in accordance with FIG. 10.

The description of the invention is merely exemplary in nature and, thus, variations that do not depart from the gist of the invention are intended to be within the scope of the invention. Such variations are not to be regarded as a departure from the spirit and scope of the invention.

REFERENCE NUMERAL LIST

| | |
|---|---|
| 1, 1' | downlight reflector |
| 2 | front reflector opening |
| 3 | rear reflector opening |
| 4 | cut-out |
| 5, 5', 5" | illuminant |
| 6 | transparent plate |
| 7 | diffuse light discharge region |
| 8 | direct light discharge region |
| 9, 10 | wall element |
| 11 | fitting |
| 12 | arched wall element |
| 13 | unit |

-continued

| REFERENCE NUMERAL LIST | |
|---|---|
| 14, 14' | housing |
| 15 | additional reflector or background reflector |
| 16 | axis |

What is claimed is:

1. A lighting device comprising a plurality of downlight reflectors (1) which are illuminated by an illuminant and which each have a front reflector opening disposed in the direction of illumination, wherein at least two downlight reflectors (1) can be illuminated by a common illuminant (5, 5") via a respective rear reflector opening, wherein the front reflector openings (2) define direct light discharge regions (8), which are surrounded at least regionally by at least one diffuse light discharge region (7), and wherein the diffuse light discharge regions (7) can be illuminated directly by sections of the common illuminant (5, 5") disposed outside the rear reflector openings (3).

2. A lighting device in accordance with claim 1, wherein the downlight reflectors (1) illuminated by the common illuminant (5, 5") in each case represent separate units not directly connected to one another.

3. A lighting device in accordance with claim 1, wherein the reflector openings (2) of the front downlight reflectors (1) disposed in the direction of illumination have an at least substantially point-symmetrical shape, in particular a circular shape, to the center of the opening (2).

4. A lighting device in accordance with claim 1, wherein the downlight reflectors (1) each have a dome or cupola shape open at both sides.

5. A lighting device in accordance with claim 1, wherein the downlight reflectors (1) illuminated by the common illuminant (5, 5") are arranged, including the illuminant (5, 5"), in a common housing (14).

6. A lighting device in accordance with claim 1, wherein at least two downlight reflectors (1) are illuminated by a plurality of common illuminants (5").

7. A lighting device in accordance with claim 6, wherein the plurality of common illuminants (5") have color shades different from one another.

8. A lighting device in accordance with claim 7, wherein three common illuminants (5") are provided which have the color shades red, green and blue.

9. A lighting device in accordance with claim 6, wherein the illuminants (5, 5") are made as fluorescent tubes.

10. A lighting device in accordance with claim 1, wherein the downlight reflectors (1) are held pivotally, in particular jointly pivotally, in a housing (14).

11. A lighting device in accordance with claim 10, wherein the downlight reflectors (1) are held pivotally in the housing (14) together with the illuminant (5, 5") illuminating them, with additional wall elements (9, 10, 12) through which scattered light passes in particular becoming visible with outwardly pivoted downlight reflectors (1).

12. A lighting device in accordance with claim 1, wherein the reflector openings (2) defining the direct light discharge regions (8) are each associated with direct light reflectors (1) on whose side remote from the respective direct light discharge region (8) an additional reflector or background reflector is provided.

13. A lighting device in accordance with claim 12, wherein a light passage region is formed between the additional reflector (15) and the direct light reflector (1).

14. A lighting device in accordance with claim 12, wherein the additional reflector (15) is formed at least partly by at least one planar reflector surface or one presettably—in particular rotationally symmetrically—curved reflector surface or one kinked reflector surface which ensures a presettable division of the portion of the reflected light guided to the direct light discharge region (8) and to the diffuse light discharge region (7).

15. A lighting device in accordance with claim 1, wherein the illuminant (5, 5") and the direct light reflectors (1) are arranged in a housing (14) which is in particular lightproof and/or dust-proof and whose inner surface is made at least regionally as an additional reflector (15).

16. A lighting device in accordance with claim 1, wherein the direct light reflectors (1) are made specularly reflecting or diffusely reflecting at their outer sides.

17. A lighting device in accordance with claim 1, wherein a housing is terminated in an at least largely dustproof manner by a scattering plate in the region of the diffuse light discharge region (7) and by an in particular transparent plate (6) in the region of the direct light discharge regions (8).

18. A lighting device in accordance with claim 1, further comprising a common housing (14) that is made to be covered by one of a scattering plate and an element having openings, in particular a perforated plate, in the region of the diffuse light discharge region (7) and is made to be open in the region of the direct light discharge region (8).

19. A lighting device in accordance with claim 1, wherein the diffuse light discharge regions (7) of a plurality of downlight reflectors (1)are formed by a common rectangular scattering plate.

20. A lighting device in accordance with claim 19, wherein the common rectangular scattering plate is made integrally with a transparent plate (6) terminating the front reflector openings.

* * * * *